US007067028B2

(12) United States Patent
Aono

(10) Patent No.: US 7,067,028 B2
(45) **Date of Patent: *Jun. 27, 2006**

(54) PROCESS FOR FORMING IMAGE

(75) Inventor: Toshiaki Aono, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 50 days.

This patent is subject to a terminal disclaimer.

(21) Appl. No.: 10/828,163

(22) Filed: Apr. 21, 2004

(65) Prior Publication Data

US 2004/0197695 A1 Oct. 7, 2004

Related U.S. Application Data

(63) Continuation of application No. 10/106,044, filed on Mar. 27, 2002.

(30) Foreign Application Priority Data

Mar. 28, 2001 (JP) ..... 2001-93939

(51) Int. Cl.
*G03G 15/20* (2006.01)

(52) U.S. Cl. ..... 156/234; 430/124; 430/198; 430/47

(58) Field of Classification Search ..... 156/230, 156/234, 247, 249, 344; 430/124, 126, 198, 430/47
See application file for complete search history.

(56) References Cited

U.S. PATENT DOCUMENTS

| | | | | |
|---|---|---|---|---|
| 5,363,179 | A | 11/1994 | Cahill et al. | |
| 5,976,736 | A | 11/1999 | Kawase et al. | |
| 6,017,636 | A * | 1/2000 | Tada et al. | 428/423.1 |
| 6,300,030 | B1 | 10/2001 | Weinberg et al. | |

FOREIGN PATENT DOCUMENTS

| | | |
|---|---|---|
| EP | 1 022 157 A2 | 7/2000 |
| GB | 2 151 189 A | 7/1985 |
| JP | 07-314930 | 12/1995 |
| JP | 9-197719 | 7/1997 |

OTHER PUBLICATIONS

Machine translation of JP 09-197719 Jul. 1997.
Websters II, New Riverside Dictionary. (1984) p. 679, "latent".

* cited by examiner

*Primary Examiner*—James Sells
(74) *Attorney, Agent, or Firm*—Sughrue Mion, PLLC

(57) ABSTRACT

A process for forming an image, the process including the steps of: forming, on a surface of an image receiving layer of an image receiving body A, an adhesive first image including an adhesive composition by using an electrophotographic technique; forming an inorganic pigment second image on the surface of the image receiving layer of the image receiving body A by transferring a transfer layer corresponding to the adhesive first image, transferring an inorganic pigment second image onto an image receiving body B, arranging the inorganic pigment second image on a surface of a ceramic material; and heating the ceramic material to sinter the inorganic pigment image onto the surface of the ceramic material.

14 Claims, 4 Drawing Sheets

PROCESS FOR FORMING IMAGE

This is a continuation of application Ser. No. 10/106,044 filed Mar. 27, 2002; the disclosure of which is incorporated herein by reference.

BACKGROUND OF THE INVENTION

1. Field of the Invention

The present invention relates to a process for forming an image comprising an inorganic material, and more particularly, it relates to a process for forming a semipermanent sintered image comprising an inorganic material on ceramic materials used for building materials, such as artistic tiles, and ceramic products.

2. Description of the Related Art

Ceramic materials having black-and-white or color images formed on the surface thereof are utilized not only in building materials, such as artistic tiles used on walls in bathrooms and entranceways, but also in ceramic photographs, such as portraits, and accessories, such as pendants and broaches.

As a process for forming an image on the surface of a ceramic material, an electrophotographic process has been known in which a colored toner comprising an inorganic material exhibiting color is applied imagewise to form an image. JP-A No.9-197719 discloses an example of such an electrophotographic process, in which a colored toner image is formed from an electrostatic image having been made by using a colored toner comprising an inorganic material, and the toner image is transferred to an image receiving body.

However, when a multi-color or full color image is to be formed by this process, plural kinds of toners corresponding to the pigments of respective colors are necessarily prepared, e.g., a yellow toner (Y), a magenta toner (M) and a cyan toner (C), and the toners must be designed to have the characteristics of respective pigments. Furthermore, when the colored toner contains iron or an oxide thereof, the toner is liable to turn blackish upon calcining, whereby an image having a desired hue is difficult to obtain.

When a multi-color or full color image is to be formed, it is necessary to use a printer for forming a color image, which is generally expensive.

Another process for forming an image on a ceramic material has also been known, where a transfer sheet having a transfer layer comprising a transfer material including an inorganic pigment is prepared, and the transfer material in the transfer sheet is thermally transferred to the ceramic material to form an image.

However, when an image is formed by the transfer process, while no problem arises when using only a single transfer processing (i.e., monochrome transferring) per one image receiving body, it is difficult to obtain desired hues when a multi-color or full color image is to be formed, and problems arise with respect to resolution and gradation. That is, when plural transfer sheets having different hues are laminated on one image receiving body to obtain a multi-color or full color image, a transfer material used in the second or later transfer processings is deposited on a transfer material that has already been transferred (i.e., a part that should not be colored), whereby desired hues cannot be obtained. This phenomenon is referred to as secondary color fogging, resulting from the facts that the transfer material contains a thermoplastic resin having adherent properties.

SUMMARY OF THE INVENTION

Therefore, an object of the present invention is to provide a process for forming an image by utilizing an electrophotographic technique and a transfer method, in which an image comprising an inorganic material having excellent resolution and gradation is formed on the surface of a ceramic material with a simple processing and a low cost without deviation of hues due to color mixing even when forming a multi-color or full color image.

The above object is attained by the present invention described below.

(1) A process for forming an image, comprising the steps of:

forming, on a surface of an image receiving layer of an image receiving body A including a support having disposed thereon the image receiving layer, an adhesive first image comprising an adhesive composition, by creating an electrostatic latent image through imagewise exposure using an electrophotographic technique and developing the electrostatic latent image;

forming, on the surface of the image receiving layer of the image receiving body A, an inorganic pigment second image that includes a transfer material including an inorganic pigment, by at least contacting the surface of the image receiving layer of the image receiving body A, having the first image formed thereon, with a surface of a transfer layer of a transfer sheet, which transfer layer comprises the transfer material, heating, and transferring the transfer layer corresponding to the adhesive first image onto the surface of the image receiving layer of the image receiving body A;

transferring, onto a surface of an image receiving layer of an image receiving body B including a support having disposed thereon the image receiving layer, the inorganic pigment second image, by at least contacting the surface of the image receiving layer of the image receiving body A with the surface of the image receiving layer of the image receiving body B, and heating the same;

arranging, either before or after peeling off the support of the image receiving body B, the inorganic pigment second image on a surface of a ceramic material; and heating the ceramic material, having the inorganic pigment second image at least arranged thereon, to thereby sinter the inorganic pigment image onto the surface of the ceramic material.

(2) A process for forming an image, comprising the steps of:

forming, on a surface of an image receiving layer of an image receiving body A including a support having disposed thereon the image receiving layer, an adhesive first image comprising an adhesive composition, by creating an electrostatic latent image through imagewise exposure using an electrophotographic technique and developing the electrostatic latent image;

forming, on the surface of the image receiving layer of the image receiving body A, an inorganic pigment second image that includes a transfer material including an inorganic pigment, by at least contacting the surface of the image receiving layer of the image receiving body A, having the first image formed thereon, with a surface of a transfer layer of a transfer sheet, which transfer layer comprises the transfer material, heating, and transferring the transfer layer corresponding to the adhesive first image onto the surface of the image receiving layer of the image receiving body A;

transferring, onto a covercoat layer of an image receiving body C including a support having disposed thereon the covercoat layer, the inorganic pigment second image, by at least contacting the surface of the image receiving layer of the image receiving body A with the surface of the covercoat layer of the image receiving body C, and heating the same;

arranging, either before or after peeling off the support of the image receiving body C, the inorganic pigment second image and the covercoat layer on a surface of a ceramic material; and heating the ceramic material, having the inorganic pigment second image and the covercoat layer at least arranged thereon, to thereby sinter the inorganic pigment image onto the surface of the ceramic material.

DESCRIPTION OF THE PREFERRED EMBODIMENTS

Embodiments of the present invention are described in detail below with reference to the drawings.

FIRST EMBODIMENT

In the first embodiment of the process for forming an image according to the present invention, an adhesive first image including an adhesive composition is formed on a surface of an image receiving layer of an image receiving body A by using an electrophotographic technique (a first image forming step); an inorganic pigment second image is formed on the surface of the image receiving body A by transferring a transfer layer corresponding to the adhesive first image (a second image forming step); the inorganic pigment second image thus formed is transferred onto an image receiving body B (an image transferring step); a covercoat layer is formed on an image receiving layer of the image receiving body B having the inorganic pigment second image transferred thereon (a covercoat layer forming step); the inorganic pigment second image is arranged on a surface of a ceramic material (an arranging step); and heat is applied to the ceramic material to sinter the inorganic pigment second image onto the surface of the ceramic material (a calcining step). The process for forming an image according to the first embodiment of the present invention is described in detail below. In the process for forming an image according to the present invention, the covercoat layer forming step is not necessarily included.

The process for forming an image according to the first embodiment of the present invention includes at least the first image forming step, the second image forming step, the image transferring step, the covercoat layer forming step, the arranging step and the calcining step, and may further include additional steps as necessary. The process for forming an image according to the first embodiment of the present invention is described with reference to FIGS. 1A to 1K. FIGS. 1A to 1K are schematic diagrams showing a basic process for forming an image according to the first embodiment of the present invention.

Figure 1A:
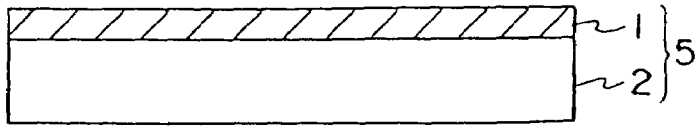
FIGS. 1A to 1K are schematic diagrams showing a basic process for forming an image according to the first embodiment of the present invention.
Figure 1B:
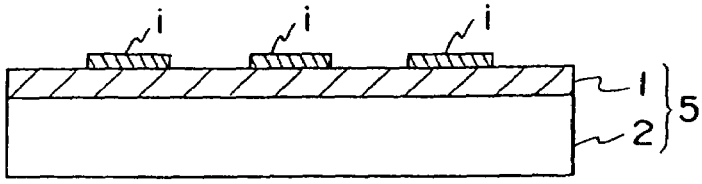

As shown in FIG. 1A, an image receiving body A5 is prepared which includes a support 2 having disposed on the surface thereof at least one image receiving layer 1 on which an image is capable of being formed. An electrostatic latent image has been previously created by the electrophotographic technique, and the electrostatic latent image is developed with a toner including at least a binder resin to exhibit adhesiveness (hereinafter referred to as an adhesive toner), to thereby form an adhesive toner image (hereinafter sometimes referred to as an adhesive first image). Thereafter, as shown in FIG. 1B, the adhesive toner image is transferred onto the surface of the image receiving layer 1 of the image receiving body A5 to thus form an adhesive first image i having a desired pattern (the first image forming step). The adhesive toner described herein have a color insofar as it becomes colorless after sintering, but is preferably colorless or light-colored.

Figure 1C:
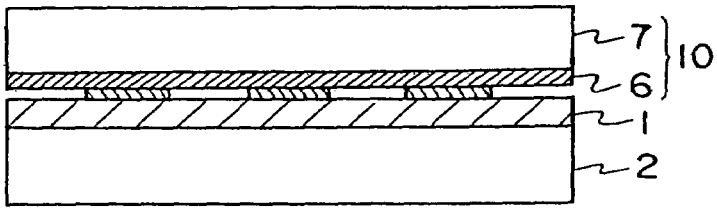

Next, as shown in FIG. 1C, a transfer sheet 10 is prepared comprising a support 7 having disposed on the surface thereof at least a transfer layer 6 containing a transfer material including an inorganic pigment. The surface of the image receiving layer 1 of the image receiving body A5 having the first image i formed thereon is superposed with the surface of the transfer layer 6 of the transfer sheet 10 such that both surfaces may face and contact each other, and they are laminated by heating under, as necessary, application of pressure.

Figure 1D:
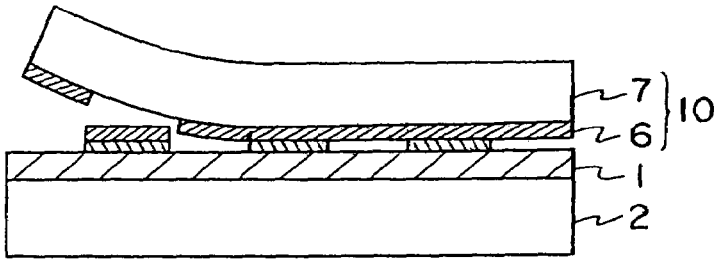
Figure 1E:
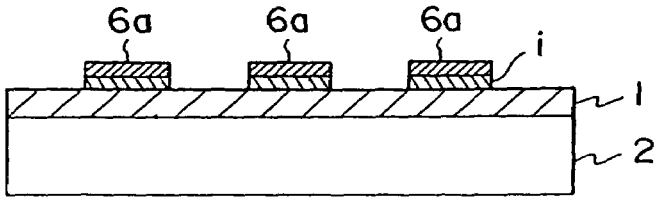

After lamination, the transfer sheet 10 is peeled off as shown in FIG. 1D, and the transfer layer 6 is transferred onto only the region corresponding to the first image i, whereby an inorganic pigment image 6*a* (i.e., an image including the transfer material or the transfer material and a part or the whole of the adhesive toner) is formed on the image receiving layer 1 as shown in FIG. 1E (the second image forming step).

When a multi-color or full color image is formed, the first image forming step and the second image forming step are repeated using plural transfer sheets having different hues, to thereby form inorganic pigment images exhibiting respective colors on plural image receiving bodies A.

Figure 1F:
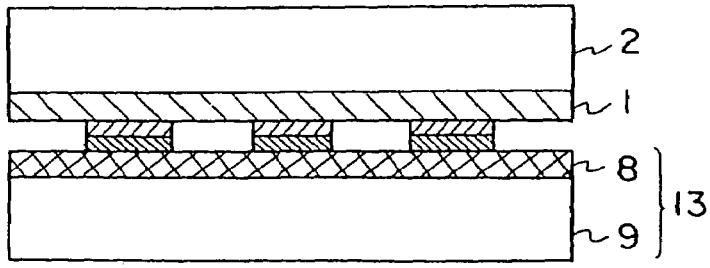

Subsequently, as shown in FIG. 1F, an image receiving body B13 is prepared which includes a support 9 having disposed on the surface thereof an image receiving layer 8. The surface of the image receiving layer 8 of the image receiving body B13 is superposed with the surface of the image receiving layer 1 of the image receiving body A5 having the inorganic pigment image formed thereon during the image forming steps such that both surfaces may face and contact each other, followed by lamination by heating under, as necessary, application of pressure.

Figure 1G:
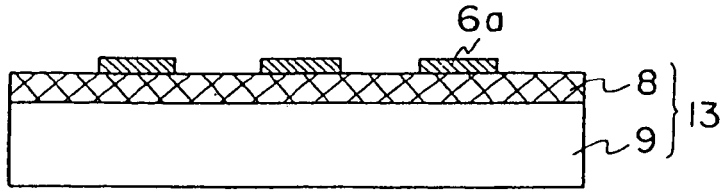

After lamination, the image receiving body A5 is peeled off, and the inorganic pigment image 6*a* formed on the image receiving layer 1 of the image receiving body A5 is transferred onto the image receiving layer 8 of the image receiving body B13, as shown in FIG. 1G (the image transferring step).

When a multi-color or full color image is formed, the respective image receiving bodies A having the inorganic pigment images exhibiting respective colors are laminated successively with the (same) image receiving body B to transfer the inorganic pigment images of respective colors onto the image receiving layer of the image receiving body B, to finally form a multi-color or full color image is formed on the image receiving body B.

Because a multi-color image is formed on the image receiving body B through the image receiving bodies A, desired hues can be obtained without causing secondary color fogging, and thus an image having excellent resolution and gradation can be obtained.

Figure 1H:
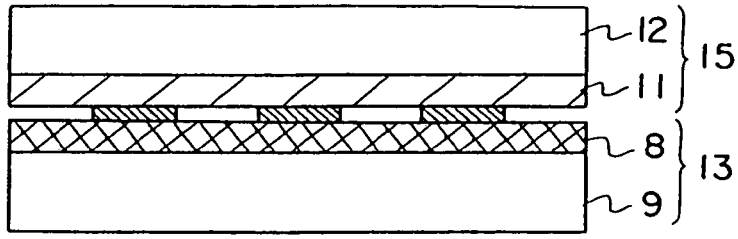
Figure 1I:
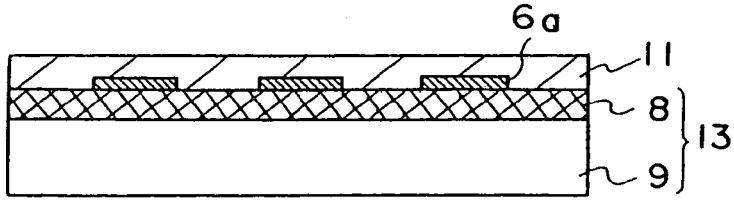

Next, as shown in FIG. 1H, a transfer material 15 is prepared which includes a support 12 having disposed on the surface thereof a covercoat layer 11. The surface of the covercoat layer 11 of the transfer material 15 is superposed with the surface of the image receiving layer 8 of the image receiving body B13 having the inorganic pigment image 6*a* transferred thereto during the image transferring step such that both surfaces may face and contact each other, followed by lamination by heating under, as necessary, application of pressure. After lamination, the support 12 of the transfer material 15 is peeled off, to allow the covercoat layer 11 to be transferred onto the image receiving layer 8 of the image receiving body B13 through the inorganic pigment image 6*a*, as shown in FIG. 1I (the covercoat layer forming step).

In the following step, the inorganic pigment image 6*a* is arranged on a ceramic material. And in an arbitrary step either before or after the arrangement, the support 9 and the image receiving layer 8 of the image receiving body B13 are separated from each other at the interface therebetween. For example, when the support 9 of the image receiving body B13 includes a water permeable support and the image receiving layer 8 contains a water soluble polymer, a part of the image receiving body B13 is brought into contact with or immersed in a liquid, such as water, to allow water to permeate into the support 9 to thus dissolve a part of the water soluble polymer so that the support 9 can easily be peeled off and removed. (The surface in a partially dissolved state, from which the support 9 has been peeled off, is referred to as a peeling surface.)

Figure 1J:
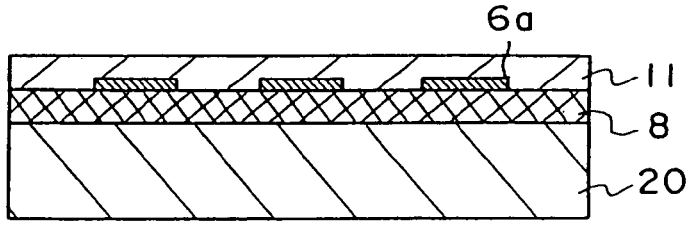
Figure 1K:
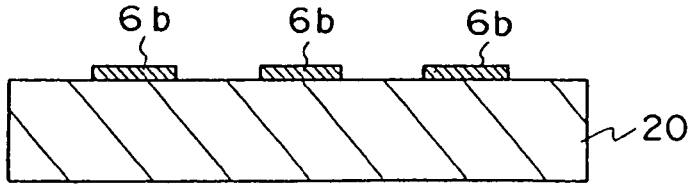

After peeling off the support 9, the inorganic pigment image 6*a* is arranged on a surface of a desired ceramic material 20 together with the covercoat layer 11. As shown in FIG. 1J, they may be arranged on the surface of the ceramic material in such a manner that the peeling surface contacts the ceramic body in a state where the water soluble polymer included in the image receiving layer 8 is partially dissolved. Alternatively, they can be arranged in such a manner that the surface opposite to the peeling surface, i.e., the surface of the covercoat layer 11, is brought into contact with the surface of the desired ceramic material through a solution having an adhesive dissolved or dispersed therein (the arranging step).

After the inorganic pigment image 6*a* and the covercoat layer 11 have been thus arranged on the surface of the ceramic material 20 by the foregoing process, heat is applied to the ceramic material 20 (shown in FIG. 1J) so that the organic substances, i.e., the covercoat layer 11, the image receiving layer 8 and the organic binder contained in the inorganic pigment image 6*a*, are burnt away, and the inorganic pigment image 6*a* is sintered onto the surface of the ceramic material 20, to thus form an image 6*b* comprising an inorganic material (the calcining step).

The respective steps are described in more detail below.

First Image Forming Step

In the first image forming step, an adhesive first image, which is preferably colorless or light-colored, is formed on a surface of an image receiving layer of an image receiving body A comprising a support having disposed on the surface thereof the image receiving layer, by utilizing the electrophotographic technique. That is, an electrostatic latent image formed by using the electrophotographic technique is developed to form the adhesive first image comprising an adhesive composition including a binder resin and then is transferred to form an adhesive first image onto the image receiving layer of the image receiving body A.

The adhesive composition described above must be capable of being adhered to a transfer layer and peeling off (transfering) the transfer layer (transfer material), and hence the composition includes at least a thermoplastic resin (binder resin) and, as necessary, a heat-melting inorganic substance.

The thermoplastic resin can appropriately be selected from conventionally known thermoplastic resins such as, for example, the binder resins described later. Examples of heat-melting inorganic substances include those usable in the transfer layer of a transfer sheet described later.

The adhesive first image comprising the adhesive composition is required to have an adhesive force between the transfer layer of the transfer sheet and the first image is larger than the adhesive force between the transfer layer of the transfer sheet and the support. If the adhesive composition ensures an adhesive force to allow transferring of the transfer layer, sufficient transfer properties can be obtained for forming an image exhibiting high resolution and high gradation.

The adhesive composition may generally be either a colored toner, which can be produced according to the toner producing techniques employed in the conventionally electrophotographic field, or a colorless or light-colored toner, which contains substantially no coloring material capable of forming a colored image after calcining but contains a binder resin to exhibit adhesiveness and can be produced according to the toner producing techniques employed in the conventionally electrophotographic field. Commercially available toners may be used as the toner. Toners containing no magnetic component, such as iron and iron oxide, are preferred because such toners are not colored by calcining and can provide the resulting image with a desired hue.

In the present invention, the electrophotographic technique using the colorless or light-colored adhesive composition can be employed according to the process described in JP-A No.9-197719, in which development is carried out with a colorless or light-colored toner free of inorganic coloring material, i.e., a toner having an adhesive ability and including at least a binder resin and, as necessary, a heat melting inorganic substance (adhesive toner), is used instead of the colored toner, so as to form a colorless or light-colored first image, followed by transferring of the first image thus formed onto the surface of the image receiving layer of the image receiving body A.

Examples of binder resins contained in the adhesive composition include those disclosed in the paragraph [0012] of JP-A No.9-197719, and from the standpoint of ensuring sufficient adhesiveness, a polyester resin, a butyral resin, an ethylene-vinyl acetate resin, an acrylic resin and the like are preferred.

The amount of the thermoplastic resin (binder resin) to be added is not particularly limited, but is preferably 50% by mass or more based on the total amount (mass) of the adhesive composition (adhesive toner) from the standpoint of ensuring adhesiveness of the transfer layer in the second image forming step (i.e., the transferring properties) and forming an image exhibiting high resolution.

When the adhesive composition (adhesive toner) contains a binder resin and a heat-melting inorganic substance, the amount of the binder resin to be added is preferably 10% by mass or more, more preferably 45% by mass or more, and particularly preferably 55% by mass or more, based on the total amount (mass) of the toner. Usually, the upper limit thereof is about from 60 to 85% by mass. If the amount is 55% by mass or more, desired characteristics as an electrophotographic toner, for example, electrostatically charging characteristics and fixing characteristics, can be ensured.

Examples of the heat-melting inorganic substance include those disclosed in the paragraphs [0006] to [0011] of JP-A No.9-197719. The amount of the heat melting inorganic substance to be added is preferably from 10 to 50% by mass based on the addition amount of the thermoplastic resin (binder resin).

The adhesive toner may further contain an auxiliary component, such as a charge controlling agent. Preferred examples of charge controlling agents include those disclosed in JP-A No.9-197719.

Second Image Forming Step

In the second image forming step, after having formed the first image by utilizing the electrophotographic technique, an image corresponding to the first image is transferred and formed. That is, the surface of the image receiving layer of the image receiving body A having the adhesive first image formed thereon is brought into contact with a surface of a transfer layer of a transfer sheet containing an inorganic pigment, followed by heating, to allow transferring of the transfer layer onto the surface of the image receiving layer of the image receiving body A corresponding to the first image, to thereby form an inorganic pigment image containing the transfer material on the surface of the image receiving layer of the image receiving body A.

In this step, heating is carried out under conditions where the surface of the image receiving layer of the image receiving body A having the latent image formed thereon is brought into contact with the surface of the transfer layer of the transfer sheet, while applying pressure as necessary. It is preferred that pressure is applied with heating from the standpoint of adhesiveness of the layers. For example, this step can preferably be carried out by conducting lamination by passing them through a pair of heating nip rollers having a built-in heating means, such as a heater.

The heating temperature for lamination is preferably from 60 to 150° C.

The transfer sheet used for forming an inorganic pigment image is described below.

The transfer sheet comprises a support having disposed on the surface thereof a transfer layer containing a colored transfer material including an inorganic pigment, and may further include other layers, such as a cushioning layer and a layer to be peeled off, and a covering layer.

The transfer material includes at least inorganic pigments. Preferably the material contains a binder together with the inorganic pigments, and may further include, as necessary, additional components, such as a flux, a plasticizer and a wax.

As inorganic pigments, an overglaze color and an underglaze color that are usually used for a ceramic art can be used, and examples thereof include metallic oxides, such as copper oxide and cobalt oxide having a crystalline structure of spinel, sphene, pyrochlore, rutile, pridelite, phosphate, phenakite, periclase, olivine, baddeleyite, borate, corundum and zircon; a sulfide, such as cadmium yellow; and a cadmium selenide compound, such as selenium red. Inorganic pigments, which are fluorescent pigments or luminious pigments, may also be used.

It is also preferable to use a flux in combination with the inorganic pigment from the standpoint of improving a fusing property of the inorganic pigment to the surface of the ceramic material. Examples of the flux include lithium carbonate, sodium carbonate, potassium carbonate, lead oxide, bismuth oxide, barium carbonate, strontium carbonate, calcium carbonate, magnesium carbonate, zinc oxide, aluminum oxide, aluminum hydroxide, silicon oxide, boric acid, zirconium oxide and titanium oxide. Furthermore, a composite component, such as borax, feldspar and kaolin, can be used. Fluxes may be used singly or in combination of two or more thereof, by melting, for use as a so-called frit.

The amount of the inorganic pigment to be contained in the transfer layer is preferably from 10 to 80% by mass, and more preferably from 20 to 70% by mass. When the flux is used in combination with the inorganic pigment, the amount of a mixture of the flux and the inorganic pigment to be contained in the transfer layer is preferably from 15 to 70% by mass, and more preferably from 30 to 80% by mass, while the preferred amount of the flux to be added varies depending on the kind of inorganic pigments used.

As the binder, any polymer, either a homopolymer or a copolymer, may be used, which consists of a single monomer or a combination of two or more kinds of monomers. It is preferable from the standpoint of the relation with the image receiving layer to which the transfer layer containing the transfer material is to be transferred, that the polymer used in the transfer layer and the polymer used in the image receiving layer each contain as a constitutional unit 30% by mole or more of a monomer which has the same functional group (hereinafter referred to as a polymer containing the same functional group). It is sufficient if at least a single kind of monomer in each layer shares the same functional group, and the monomer in each layer may further contain functional groups different from each other. Examples of the same functional group described herein include a butyral group, a vinyl alcohol group, an amino group, an amide group, an imino group, an imide group, a styrene group, an alkoxy group, methacrylic acid and an ester group thereof, acrylic acid and an ester group thereof, maleic acid and an ester group thereof, a vinyl ether group and a vinyl acetate group. Among these, a butyral group is preferred.

The monomer having the same functional group is preferably contained, as a constitutional unit, in the polymer in the transfer layer and the polymer in the image receiving layer described later in an amount as large as possible. The content of the monomer is preferably at least 30% by mole, more preferably 50% by mole or more, and particularly preferably 80% by mole or more.

If the content of the monomer having the same functional group as a constitutional unit of the polymer is less than 30% by mole, the polymer in the transfer layer and the polymer in the image receiving layer has a significant different nature, leading to an increased unevenness in the image.

Specifically, an amorphous organic high polymer having a softening point of from 40° C. to 150° C. is preferred as the binder. Examples of amorphous organic high polymers include a butyral resin, a polyamide resin, a polyethyleneimine resin, a sulfonamide resin, a polyester polyol resin, a petroleum resin, a homopolymer or copolymer of styrene and the derivative and the substituted product thereof, such as styrene, vinyltoluene, α-methylstyrene, 2-methylstyrene, chlorostyrene, vinylbenzoate, sodium vinylbenezensulfonate and aminostyrene, a homopolymer of a methacrylate and methacrylic acid, such as methyl methacrylate, ethyl methacrylate, butyl methacrylate and hydroxyethyl methacrylate, an arcylate and acrylic acid, such as methyl acrylate, ethyl acrylate, butyl acrylate and α-ethylhexyl acrylate, dienes, such as butadiene and isoprene, acrylonitrile, a vinyl ether, maleic acid, maleates, maleic anhydride, cinnamic acid, and a vinyl monomer, such as vinyl acetate, and a copolymer of these monomers with other monomers. The binder may be a mixture of two or more kinds of these polymers.

The amount of the binder to be added is preferably from 10 to 300% by volume, and more preferably from 20 to 200% by volume, based on the total added amount of the inorganic pigment and the flux (i.e., the amount of the inorganic components). If the amount is less than 10% by volume, the layer may become brittle to thereby impair resistance to flaws, and if it exceeds 300% by volume, the thickness of the transfer layer may increase to thus lower the resolution and the gradation.

The thickness of the transfer layer is generally from 0.2 μm to 6 μm, and preferably from 0.5 μm to 3 μm.

When a multi-color image is formed on the image receiving layer, a plasticizer is preferably included in the transfer material from the standpoint of improving adhesiveness between the images.

Examples of plasticizers include phthalates, such as dibutyl phthalate, di-n-octyl phthalate, di(2-ethylhexyl)phthalate, dinonyl phthalate, dilauryl phthalate, butyllauryl phthalate and butylbenzyl phthalate, aliphatic dibasic acid esters, such as di(2-ethylhexyl)adipate and di(2-ethylhexyl)sebacate, phosphoric acid triesters, such as tricresyl phosphate and tri(2-ethylhexyl)phosphate, polyol polyesters, such as a polyethylene glycol ester, and epoxy compounds, such as an epoxy fatty acid ester. In addition to these plasticizers, acrylate compounds, such as polyethylene glycol dimethacrylate, 1,2,4-butanetriol trimethacrylate, trimethylolethane triacrylate, pentaerythritol triacrylate, pentaerythritol tetraacrylate and dipentaerythritol polyacrylate, may be preferably used depending on the species of the binder used. The plasticizers may be used in combination of two or more thereof. Further, a surface active agent and a thickening agent may be added as necessary.

The amount of the plasticizer to be included in the transfer layer is preferably from 100/1 to 100/3, and more preferably from 100/1.5 to 100/2, in terms of the ratio (S/s) of the total mass (S) of the inorganic pigment and the binder to the mass (s) of the plasticizer.

It is preferable to include a wax component in the transfer layer from the standpoint of improving cutoff of the transferred image (dots) and resolution.

Examples of wax components include paraffin wax, microcrystalline wax, carnauba wax, candelilla wax, rice wax, Fischer-Tropsch wax, bees wax, haze wax, whale wax, insect wax, wool wax, shellac wax, petrolatum, polyester wax, lanolin, low molecular weight polyethylene wax, amide wax, ester wax, polyethylene oxide wax, rosin, rosin methylol amide, ester gum, a higher fatty acid, a higher fatty acid ester and a higher alcohol.

In order to improve adhesiveness between the image receiving material and the transfer sheet and ensure adhesion of the transfer layer (material) during the second or later transfer processing when forming a multi-color image, the transfer layer preferably includes a thermoplastic resin having a relatively low melting point, such as a low molecular weight petroleum resin, a polyvinyl butyral resin, an ethylene/vinyl acetate copolymer, an ethylene/acrylate copolymer, a styrene/acrylate copolymer and a styrene/maleic acid/acrylate copolymer.

The transfer layer can be provided in the following manner. The components to constitute the transfer material, such as an inorganic pigment and a binder, are dissolved or dispersed in a suitable solvent to prepare a coating solution, and the coating solution is then coated on a support (if the support has a subbing layer described later, the solution is coated on the subbing layer), followed by drying. The solvent may be an organic solvent. From the standpoint of environmental safety, preferable is water or a water-miscible solvent. Examples of solvents include n-propyl alcohol, methyl ethyl ketone, propylene glycol monomethyl ether (MFG), methanol and a mixture of these solvent and water. The coating and drying processings can be carried out by utilizing conventionally known methods for coating and drying.

The support of the transfer sheet is not particularly limited and can be selected from various kinds of conventionally known materials depending on the purposes. Preferable examples thereof include synthetic resin materials, such as polyethylene terephthalate, polyethyelne-2,6-naphthalate, polycarbonate, polyethylene, polyvinyl chloride, polyvinylidene chloride, polystyrene and a styrene/acrylonitrile copolymer. Among these, a biaxially oriented polyethylene terephthalate is particularly preferable from the standpoints of mechanical strength, dimensional stability with respect to heat, and cost.

It is preferable that a surface roughening treatment is carried out and/or a single layer or two or more layers of the subbing layer is provided on the support in order to adjust the adhesiveness to the transfer layer provided on the surface of the support.

Examples of the surface roughening treatment include glow discharge treatment and corona discharge treatment. As a material for forming the subbing layer, those exhibiting appropriate adhesiveness to both the surfaces of the support and the transfer layer and having small thermal conductivity and excellent heat resistance are preferable. In view of these characteristics, for example, polystyrene, a styrene/butadiene copolymer and gelatin are preferable. The total thickness of the subbing layer is generally from 0.01 μm to 2 μm.

On the surface of the transfer sheet opposite to that on which the transfer layer is disposed, various kinds of functional layers, such as a releasing-type layer, may be provided, and a surface treatment may be carried out.

The covering sheet may be one including the same or analogous material as the support, and from the standpoint of being peeled off from the covercoat layer, for example, polyethylene terephthalate, silicone paper and polyolefin can also be preferably used. The thickness of the covering sheet is preferably about from 10 μm to 200 μm, and particularly preferable is a polyethylene or polypropylene film having a thickness of from 25 μm to 100 μm. The covering sheet is peeled off before the transferring.

Next, the image receiving body A is described.

The image receiving body A comprises a support having on the surface thereof at least one image receiving layer, and further a cushioning layer, a layer to be peeled off and an intermediate layer may be provided between the support and the image receiving layer.

The image receiving layer of the image receiving body A of the present invention preferably includes a releasing agent. As the releasing agent, for example, a silicone resin, a polyvinyl alcohol (PVA) resin and a polyethylene (PE) resin are preferable, and from the standpoints of coating properties and adhesive force, a polyvinyl alcohol (PVA) resin is particularly preferable. While the amount of the releasing agent to be employed varies depending on the species of releasing agents used, it is adjusted such that the adhesive force between the inorganic pigment image and the image receiving layer of the image receiving body A is smaller than the adhesive force between the inorganic pigment image and the image receiving layer of the image receiving body B.

The image receiving layer of the image receiving body A is not particularly limited insofar as the adhesive first image comprising the adhesive composition can be formed, and further the inorganic pigment image can be transferred for forming an image. The image receiving layer may be a layer including as a binder either a hydrophobic polymer (i.e., the polymer containing the same functional group described above) or a water soluble polymer. It is necessary that the adhesive force between the image receiving layer of the image receiving body A and the transfer layer of the transfer sheet is smaller than the adhesive force between the image receiving layer of the image receiving body B and the transfer layer of the transfer sheet.

The thickness of the image receiving layer of the image receiving body A capable of forming an image thereon is generally from 0.3 μm to 20 μm, and preferably from 0.7 μm to 15 μm.

Examples of supports for the image receiving body A include a substrate in the form of an ordinary sheet, such as a plastic sheet, a metallic sheet, a glass sheet and paper. Examples of the plastic sheet include a polyethylene terephthalate sheet, a polycarbonate sheet, a polyethylene-2,6-naphthalate sheet, a polyvinyl chloride sheet, a polyvinylidene chloride sheet, a polystyrene sheet, a styrene/acrylonitrile copolymer sheet and a polyester sheet. Examples of the glass sheet include a glass-epoxy sheet. Examples of the paper substrate include printing paper having good smoothness and coated paper. The thickness of the support of the image receiving body A is generally from 10 μm to 400 μm, and preferably from 25 μm to 200 μm.

The surface of the support may be subjected to corona discharge treatment or glow discharge treatment in order to improve adhesiveness to the image receiving layer which is capable of forming an image thereon (or the cushioning layer) or to improve adhesiveness to the transfer layer of the transfer sheet.

By utilizing the electrophotographic technique during the first image forming step and the second image forming step, an image is formed and transferred and accordingly an image having a desired hue can easily be formed with high image quality.

Image Transferring Step

In the image transferring step, the surface of the image receiving layer of the image receiving body A having the inorganic pigment image formed thereon is at least brought into contact with the image receiving layer of the image receiving body B capable of receiving the inorganic pigment image, followed by heating, to allow transferring of the inorganic pigment image on the surface of the image receiving layer of the image receiving body A onto the surface of the image receiving layer of the image receiving body B.

In this step, heating may be carried out at least under conditions where the surface of the image receiving layer of the image receiving body A is brought into contact with the surface of the image receiving layer of the image receiving body B, while applying pressure as necessary. Preferably heat and pressure are both applied from the standpoint of adhesiveness of the layers. For example, this step can be suitably carried out by performing lamination by passing them through a pair of heating nip rollers having a built-in heating means, such as a heater.

The heating temperature employable for lamination is preferably from 50° C. to 200° C.

Next, the image receiving body B is described.

The image receiving body B comprises a support having disposed on the surface thereof at least one image receiving layer, and further a cushioning layer, a layer to be peeled off and an intermediate layer may be disposed between the support and the image receiving layer. In the present invention, it is preferable to provide one layer or two or more layers selected from a cushioning layer, a layer to be peeled off and an intermediate layer.

The image receiving layer of the image receiving body B is not particularly limited insofar as the inorganic pigment image can be transferred and formed thereon. The image receiving layer may be a layer including as a binder either a hydrophobic polymer or a water soluble polymer. When a water soluble polymer is included, the content of the water soluble polymer is preferably 30% by mass or more, more preferably 50% by mass or more, and particularly preferably 80% by mass or more.

The image receiving body B may have such a constitution that the image receiving layer is disposed on a layer which includes a water soluble polymer (hereinafter sometimes referred to as a water soluble polymer layer) from the standpoints of ease with which the support can be peeled off and ease with which it can be arranged on a ceramic material. The content of the water soluble polymer in the water soluble polymer layer is the same as that for the water soluble polymer in the image receiving layer.

In this case, it is more preferable that the support is a water permeable. During the step of forming an image, the inorganic pigment image is formed on the water soluble polymer layer, and subsequently during the step of arranging, the support can easily be peeled off by dissolution of a part of the water soluble resin by utilizing liquid permeability of the support.

A particularly preferable embodiment is one where the image receiving layer includes the polymer which has the same functional group described above (hydrophobic polymer) in the amount described above (hereinafter sometimes referred to as a hydrophobic polymer layer). In this case, the hydrophobic polymer layer functions as an image receiving layer capable of having an image transferred thereon, and the water soluble polymer layer functions as a layer to improve the ability of the support to be peeled off and impart adhesiveness to the ceramic material (i.e., a layer to be peeled off.

The water soluble polymer preferably has such a function that where the support is paper, a part of the water soluble polymer is dissolved when immersed in a liquid, such as water, to allow peeling of the paper support, and simultaneously, the inorganic pigment image after peeling can be adhered onto the surface of the ceramic material through the peeling surface of the inorganic pigment image. Incidentally, sufficient adhesion to the water soluble polymer layer refers to the state where the inorganic pigment image is disposed on the surface of the ceramic material without dimensional deviance.

In view of the foregoing, preferable examples of water soluble polymers include a polymer used for decoration of pottery and porcelain, such as dextrin and gum arabic, polyvinyl alcohol, carboxymethyl cellulose, methyl cellulose, hydroxyethyl cellulose and gelatin.

As the hydrophobic polymer, a thermoplastic resin may be used in combination with the polymer containing the same functional group described above. Examples of the thermoplastic resin include a polyvinyl butyral resin, an ethylene/vinyl acetate copolymer, an ethylene/acrylate copolymer, a styrene/acrylate copolymer, a styrene-maleic acid/acrylate copolymer, polyamide, polystyrene, polyester, a polyvinyl acetate resin, a cellulose derivative, a polystyrene methacrylic resin, a polyvinyl ether resin, a polyurethane resin, a polycarbonate resin and a rosin resin. A resin used as an overglaze overprint lacquer for decoration of pottery and porcelain, such as a ceramic ware, is also preferred, and for example, an acrylic resin and a urethane resin can be used in combination with the above resins.

The thickness of the image receiving layer of the image receiving body B is generally from 0.3 μm to 30 μm, and preferably from 0.7 μm to 15 μm. The thickness of the water soluble polymer layer of the adhesive image receiving body is preferably from 0.2 μm to 20 μm.

Covercoat Layer Forming Step

In the covercoat layer forming step, a covercoat layer is formed on the image receiving layer having the inorganic pigment image formed thereon. The method for forming the covercoat layer may be either a method of coating or a method of transferring by using a transfer material.

The covercoat layer includes at least a hydrophobic polymer. Since the covercoat layer is constituted by a hydrophobic polymer as a main component, the inorganic pigment image can be retained on the surface of the covercoat layer when peeling off the support from the image receiving body by immersing it in a liquid, such as water, in the arranging step described later, and no defect occurs in the image.

Examples of hydrophobic polymers include the same kinds of binders that can be used in the transfer layer, and the polymers containing the same functional group described above are preferable. In particular, polymers having a glass transition point of room temperature or lower (environmental temperature in use) are preferable from the standpoints of enabling transfer and adhesion to an uneven surface or a curved surface. The environmental temperature in use described herein is 25° C. The glass transition point is preferably from −50° C. to 25° C., and more preferably from −30° C. to 15° C. Specific examples of the polymer as commercially available products include Covercoat Resin LO-210, LO-176S, LO-200H and LO-170H (produced by Goo Chemical Co., Ltd.).

When the covercoat layer is disposed by coating, a coating solution is prepared which contains at least the hydrophobic polymer dissolved or dispersed in a suitable solvent, and the coating solution is coated on the surface of the image receiving layer having the inorganic pigment image formed thereon, followed by drying, by using conventionally known coating methods, to thereby form a covercoat layer. As the solvent, the same kinds of solvents used for preparing the coating solution for the transfer layer can be employed.

When the covercoat layer is formed by transferring by using a transfer material, a transfer material comprising a support having disposed thereon a covercoat layer is used, and the surface of the image receiving layer of the image receiving body B having the inorganic pigment image transferred thereon is at least brought into contact with the surface of the covercoat layer of the transfer material having the covercoat layer, followed by heating, to allow transferring of the covercoat layer onto the image receiving layer of the image receiving body. That is, the covercoat layer is superposed so as to cover the inorganic pigment image, and heat is applied to adhere them, whereby a laminated body is formed. Thereafter, the support of the transfer material is peeled off and removed from the laminated body, to thus transfer and provide the covercoat layer on the entire surface or a part of the surface of image receiving layer.

In the process of applying heat for producing the laminated body, heat application can be carried out while applying pressure, and for example, the layers can be adhered by lamination using an apparatus (for example, a heat roll laminator) having a pair of heating nip rollers having a built-in heating means, such as a heater. The heating temperature employed for lamination is preferably from 50° C. to 200° C.

The transfer material comprises a support having disposed on the surface thereof a covercoat layer, and the material may further comprise additional layers, such as a frit layer and a covering sheet, as necessary. The support and the covering sheet described herein are not particularly limited, and those similar to the support and the covering sheet constituting the transfer sheet described above can be used.

The covercoat layer may include frit. When frit is included, the inorganic pigment image is firmly sintered onto the ceramic material, to thus increase the image stability after sintering.

Examples of the frit include those that can be used in the transfer layer of the transfer sheet described above. The amount of the frit to be added is preferably from 10 to 90% by mass based on the amount (mass) of the hydrophobic polymer in the covercoat layer.

The thickness of the covercoat layer is preferably from 3 μm to 30 μm, and more preferably from 5 to 20 μm. If the thickness is less than 3 μm, handling properties of the inorganic pigment image may be impaired when arranging it on the ceramic material. If the thickness exceeds 30 μm, the image may become uneven upon sintering.

It is preferable to provide a frit layer on the surface of the covercoat layer that is not in contact with the support, whether or not the covercoat layer includes frit. The frit layer includes at least frit and a thermoplastic resin, and the thickness of the layer is preferably 1 μm to 5 μm.

Examples of the frit include those similar to the flux that can be used in the transfer layer of the transfer sheet described above. The content of the frit in the frit layer is preferably from 10 to 80% by mass based on the amount (mass) of thermoplastic resin. As the thermoplastic resin, the binders and wax employed in the transfer layer of the transfer sheet can be used.

Arranging Step

In the arranging step, either before or after peeling off the support from the image receiving body, the inorganic pigment image is arranged on the surface of the ceramic material together with the covercoat layer.

The arrangement on the surface of the ceramic material may be carried out by applying heat and pressure, as necessary, to the inorganic pigment image together with at least the covercoat layer. When arranging, depending on the embodiment of the image receiving body, the image receiving layer and/or the water soluble polymer layer may be disposed between the ceramic material and the inorganic pigment image, or alternatively, the surface of the covercoat layer where the inorganic pigment image is not formed may be arranged to face the surface of the ceramic material. In the former case, it is not always necessary to remove the image receiving layer and/or the layer including a water soluble polymer (the water soluble polymer layer) of the image receiving body after having been peeled off the support, and a normal image is formed on the ceramic material. In the latter case, an inverted image is formed on the ceramic material. In the former case, an image receiving body B (adhesive image receiving body) is preferred which has such an embodiment that the layer including a water soluble polymer and the image receiving layer are successively provided on the support.

In cases where the image receiving body B is used which includes the support having successively thereon the layer including a water soluble polymer and the image receiving layer (hereinafter sometimes referred to as an adhesive image receiving body) and where the support is water permeable, a part of the water permeable support side of the image receiving body is in contact with or is immersed in a liquid, such as water, to dissolve a part of the water soluble polymer, to make the support be peeled off and removed, and then adhered onto the surface of the ceramic material at the peeling surface after having peeled off, to thus arrange the inorganic pigment image on the surface of the ceramic material together with the covercoat layer. Therefore, in this case, a liquid having an adhesive dissolved or dispersed therein is not necessary when conducting arrangement.

In case where the support is a plastic film, the plastic film support can easily be peeled off without immersing it in a liquid, such as water, when a surface treatment for imparting releasability has previously been carried out on the plastic film support as described later. In this case, arrangement on the surface of the ceramic material can be carried out through a liquid having an adhesive dissolved or dispersed therein.

The liquid, such as water, described herein not only may be water but also can be selected from those capable of dissolving the water soluble polymer present in the image receiving body, such as a mixture of water and a solvent compatible therewith.

When the inorganic pigment image on the image receiving layer is arranged as an inverted image on the surface of the ceramic material, it is possible that a desired inverted image has previously been formed on the image receiving layer of the image receiving body B, and then arranged to the ceramic material on the surface of the covercoat layer on the side where the inorganic pigment layer is not provided (i.e., the back face of the peeling side). In this case, because the surface of the covercoat layer has no adhesiveness, an image can be arranged on the surface of the ceramic material by providing a liquid having an adhesive dissolved or dispersed therein, an adhesive or a hot-melt adhesive on the surface of either the ceramic material or the covercoat layer.

Examples of the liquid having an adhesive dissolved or dispersed therein include a liquid formed by dissolving or dispersing, in a solvent, such as water, the water soluble polymers described above or a thermoplastic resin having a glass transition point of 25° C. or lower, preferably 5° C. or lower, as the adhesive.

Examples of the ceramic material include a ceramic plate, which is used as a building material, such as a tile, a ceramic ware, a pottery plate, a pottery ware and additional ceramic products. In the present invention, the ceramic material includes an enameled ware. The form of the ceramic material, such as the shape and the thickness, can be appropriately selected depending on the purposes and applications.

Calcining Step

In the calcining step, the ceramic material having at least the inorganic pigment image and the covercoat layer arranged thereon is heated to sinter the inorganic pigment image onto the surface of the ceramic material. At this point, the inorganic pigment is sintered onto the surface of the ceramic material, and the other components than the inorganic pigment and further an additional component which had been arranged together with the image on the surface of the ceramic material, such as the image receiving layer itself, are evaporated or burnt away.

Therefore, it is preferable that the materials arranged on the surface of the ceramic material together with the inorganic pigment (e.g., the components contained in the transfer layer and the image receiving layer) do not contain any atom or compound that would not disappear through evaporation or combustion during the calcining step, or any atom or compound that may cause a change in color through a reaction with the inorganic pigment.

Heating of the ceramic material is preferably carried out by using, for example, an electric furnace from the standpoints of temperature control and color developing property. The heating conditions can appropriately be set depending on the selected materials, the volume of the ceramic material and the size of the image to be formed. Heating is carried out by slowly raising the temperature to the calcining temperature, or by heating at a temperature from 300 to 500° C. for a predetermined period of time, and then gradually increasing the temperature to the calcining temperature. When an overglaze color is used as the inorganic pigment, calcining is generally carried out at a calcining temperature from 650 to 900° C., and preferably from 750 to 850° C., for a calcining period of from 10 minutes to 2 hours. When an underglaze color is used as the inorganic pigment, calcining is generally carried out at a calcining temperature from 1,000° C. to 1,300° C., and preferably from 1,100 to 1,250° C., for a calcining period of from 10 minutes to 8 hours.

As detailed above, when forming a sintered image comprising an inorganic material on ceramic materials used for building materials, such as an artistic tile, and ceramic products, images having monochrome colors each exhibiting a different hue are formed on the image receiving bodies A, and then the images having monochrome colors each exhibiting a different hue formed on the image receiving bodies A are successively transferred onto an image receiving body B, whereby a high quality image excellent in resolution and gradation without deviation in hue can be formed. Furthermore, because a multi-color image can freely be formed using a single kind of toner (plural kinds thereof may also be used), it is unnecessary to prepare toners corresponding to respective colors. Still further, because a printer for forming a monochrome image, which is relatively inexpensive, can be used, the image formation can readily be carried out at a low cost.

SECOND EMBODIMENT

In the second embodiment of the process for forming an image according to the present invention, an adhesive first image, which is preferably colorless or light-colored and comprises an adhesive composition, is formed on a surface of an image receiving layer of an image receiving body A by using the electrophotographic technique (the first image forming step); an inorganic pigment image is formed on the surface of the image receiving body A by transferring a transfer layer corresponding to the first image (the second image forming step); the inorganic pigment image thus formed is transferred onto a covercoat layer provided on an image receiving body C (the image transferring step); the inorganic pigment image is arranged on a surface of a ceramic material (the arranging step); and heat is applied to the ceramic material to sinter the inorganic pigment image onto the surface of the ceramic material (the calcining step). The process for forming an image according to the second embodiment of the present invention is described in detail below.

The process for forming an image according to the second embodiment of the present invention includes at least the first image forming step, the second image forming step, the image transferring step, the arranging step and the calcining step, and may further include additional steps as necessary.

Descriptions of the first image forming step, the second image forming step, the arranging step and the calcining step are omitted because they are substantially the same as those in the process for forming an image according to the first embodiment of the present invention, and accordingly the image transferring step is described below. In the arranging step in this embodiment, arrangement can be carried out by bringing the peeling surface or the surface having the inorganic pigment image formed thereon of the image receiving body C in contact with the ceramic material.

FIGS. 2A to 2I are schematic diagrams showing a basic process for forming an image according to the second embodiment of the present invention.

Image Transferring Step

Figure 2A:
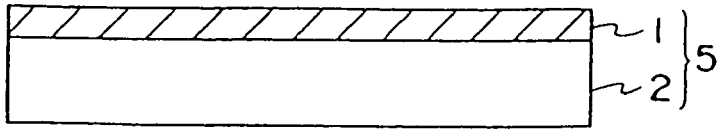
FIGS. 2A to 2I are schematic diagrams showing a basic process for forming an image according to the second embodiment of the present invention.
Figure 2B:
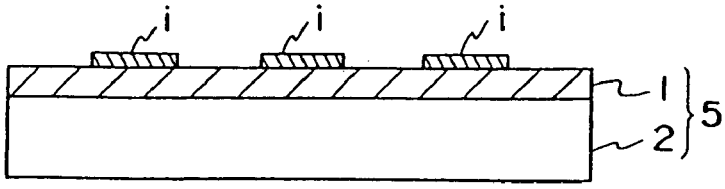
Figure 2C:
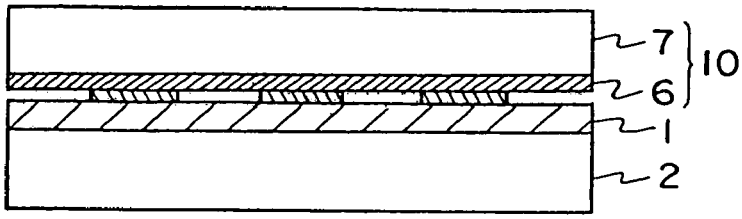
Figure 2D:
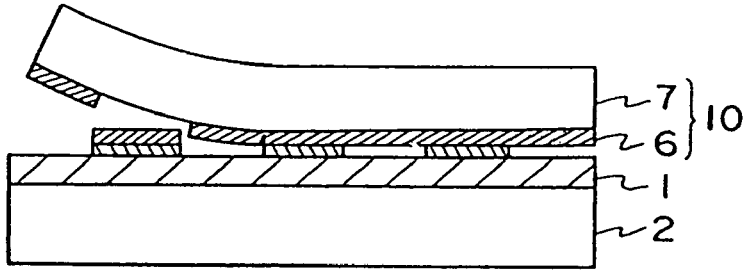
Figure 2E:
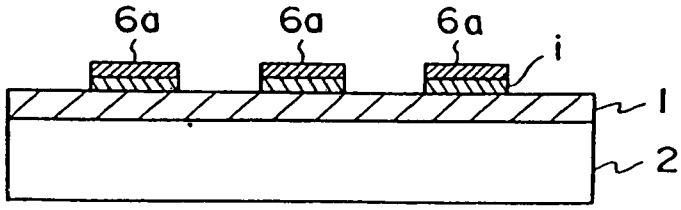
Figure 2F:
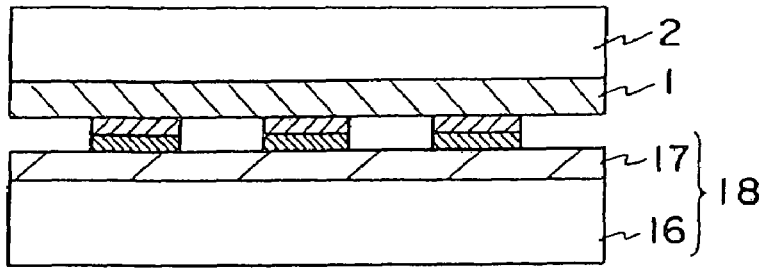

After the first image forming step and the second image forming step shown in FIGS. 2A to 2E, an image receiving body C18 comprising a support 16 having a covercoat layer 17 disposed on the surface thereof is prepared, and the surface of the covercoat layer 17 of the image receiving body C18 is superposed on the surface of the image receiving layer 1 of the image receiving body A5 having the inorganic pigment image 6*a* formed thereon during the second image forming step in such a manner that the both surfaces may face and contact with each other, followed by lamination by heating with, as necessary, applying pressure, as shown in FIG. 2F.

Figure 2G:
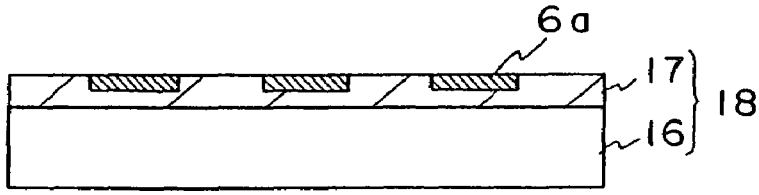
Figure 2H:
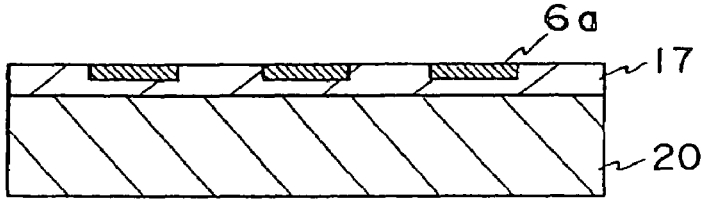
Figure 2I:
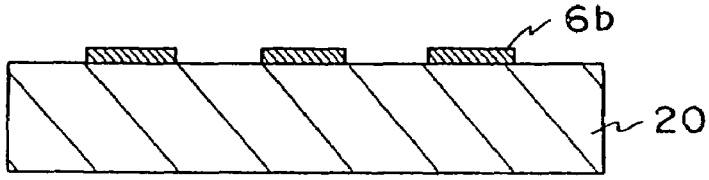

After lamination, the image receiving body A is peeled off as shown in FIG. 2G, to allow transferring of the inorganic pigment image 6*a* (or the inorganic pigment image 6*a* and a part or the whole of the adhesive toner image (the first image)) having been formed on the image receiving layer 1 of the image receiving body A5 to the covercoat layer 17 of the image receiving body C18 (the image transferring step). At this point, the image receiving layer of the image receiving body A may also be transferred together with the above image. After the image transferring step, arrangement and sintering of the inorganic pigment image 6*a* are carried out similarly to the first embodiment, as shown in FIGS. 2H and 2I.

When a multi-color or full color image is formed, plural image receiving bodies A having plural inorganic pigment images exhibiting respective colors are successively laminated with the (same) image receiving body C, whereby the inorganic pigment images formed for respective colors are entirely transferred to the covercoat layer of the image receiving body C, to finally form a multi-color or full color image on the image receiving body C.

Because a multi-color image is formed on the image receiving body C through the image receiving bodies A, desired hues can be obtained without causing secondary color fogging, and thus an image having excellent resolution and gradation can be obtained.

The image transferring step is described in more detail below.

In the image transferring step, the surface of the image receiving layer of the image receiving body A having the inorganic pigment image formed thereon is at least brought into contact with the image receiving layer of the image receiving body C having the covercoat layer capable of receiving the inorganic pigment image, followed by heating, to allow transferring of the inorganic pigment image on the surface of the image receiving layer of the image receiving body A onto the surface of the covercoat layer of the image receiving body C.

In this step, heating may be carried out at least under such a state that the surface of the image receiving layer of the image receiving body A is brought into contact with the surface of the covercoat layer of the image receiving body C, and pressure may be applied as necessary. Preferably heat and pressure are both applied from the standpoint of adhesiveness of the layers. For example, this step can preferably be carried out by conducting lamination by passing them through a pair of heating nip rollers having a built-in heating means, such as a heater.

The heating temperature is preferably from 50° C. to 200° C.

The image receiving body C is described below.

The image receiving body C has substantially the same constitution as the image receiving body B except that the covercoat layer is disposed instead of the image receiving layer.

The covercoat layer is not particularly limited insofar as the inorganic pigment image can be transferred and formed thereon, and the same layer as the covercoat layer described in the covercoat layer forming step for forming an image according to the first embodiment can be used. The thickness of the covercoat layer is preferably from 3 μm to 30 μm, and more preferably from 5 μm to 20 μm.

As described above, when forming a sintered image comprising an inorganic material on ceramic materials used for building materials, such as an artistic tile, and ceramic products, images having monochrome colors each exhibiting a different hue are formed on the image receiving bodies A, and then the images having monochrome colors each exhibiting a different hue formed on the image receiving bodies A are successively transferred onto an image receiving body C, whereby a high quality image excellent in resolution and gradation without deviation in hue can be formed. Further, because a multi-color image can freely be formed using a single kind of toner (plural kinds thereof may also be used), it is unnecessary to prepare toners corresponding to respective colors. Still further, a printer for forming a monochrome image, which is relatively inexpensive, can be used, the image formation can readily be carried out at allow cost.

EXAMPLES

The present invention will be described in more detail below with reference to examples, but the present invention is not limited thereto.

Example 1

Preparation of Adhesive Toner

An adhesive toner was prepared as an adhesive composition in the following manner.

The following components were admixed using a mixer, and then molten and kneaded using a two-roll mill. The resulting kneaded composition was calendered and cooled, followed by grinding. The powder thus obtained was classified to produce a toner having an average particle diameter of 7.5 μm. To the toner thus produced was added hydrophobic silica (R972, produced by Nippon Aerosil Co., Ltd.) in an amount of 0.5% by mass, followed by mixing in a mixer to give an adhesive toner.

| | |
|---|---|
| Polyester resin (acid value: 3, hydroxyl group value: 25, molecular weight: 40,000, glass transition point: 60° C.) | 100 parts by mass |
| Flux (19164, produced by Cerdec Co., Ltd.) | 60 parts by mass |

-continued

| | |
|---|---|
| Zinc salicylate derivative (BONTRON E84, produced by Orient Chemical Co., Ltd.) | 3 parts by mass |

Preparation of Transfer Sheet (1) Production of Yellow Transfer Sheet

Preparation of Inorganic Pigment Dispersion Y

The following components were dispersed using Micros type MC-0 (produced by Nara Machinery Co., Ltd.) to prepare an inorganic pigment dispersion Y.

| | |
|---|---|
| Yellow pigment (13651, produced by Cerdec Co., Ltd.) | 100 parts by mass |
| Water | 60 parts by mass |

Preparation of Coating Solution for a Yellow Transfer Layer

The following components were admixed and thoroughly stirred to prepare a coating solution for a yellow transfer layer (coating solution Y).

| Composition of Coating Solution Y | |
|---|---|
| Pigment Dispersion Y | 41 parts by mass |
| Polyoxyethylene nonylphenyl ether (n = 10, a 20% by mass aqueous solution) | 0.5 part by mass |
| Carnauba wax dispersion (31% by mass, K-332, produced by Chukyo Yushi Co., Ltd.) | 20 parts by mass |
| Butyral resin dispersion (25% by mass, REZEM J667, produced by Chukyo Yushi Co., Ltd.) | 60 parts by mass |
| Terpene phenol resin dispersion (35% by mass, REZEM J628, produced by Chukyo Yushi Co., Ltd.) | 5 parts by mass |

The coating solution Y was applied on a surface of a polyester film having a thickness of 25 μm to give a dry thickness of 2 μm, followed by drying, to form a yellow transfer layer, whereby a yellow transfer sheet was produced.

(2) Production of Magenta, Cyan and Black Transfer Sheets

A magenta transfer sheet, a cyan transfer sheet and a black transfer sheet were produced in the same manner as in the production of the yellow transfer sheet, except that a magenta pigment (77571, produced by Cerdec Co., Ltd.), a cyan pigment (121522, produced by Cerdec Co., Ltd.) and a black pigment (14209, produced by Cerdec Co., Ltd.) were used instead of the yellow pigment for preparing the yellow transfer sheet.

Production of Image Receiving Body A

Coating solutions for a first layer and a second layer having the following compositions, respectively, were prepared.

| Composition of Coating Solution for First Layer (Cushioning Layer) | |
|---|---|
| Vinyl chloride/vinyl acetate copolymer (SOLVAIN CL2, produced by Nisshin Chemical Industry Co., Ltd.) | 160 parts by mass |

-continued

| | |
|---|---|
| Ethylene/vinyl acetate copolymer (ELVALOY 742, produced by Mitsui Du Pont Polychemical Co., Ltd.) | 61 parts by mass |
| Sebacic acid polyester (FN-G25, produced by Nippon Soda Co., Ltd.) | 28 parts by mass |
| Perfluoroalkyl group-containing oligomer (MEGAFACK F-178K, produced by Dainippon Ink and Chemicals, Inc.) | 4 parts by mass |
| Methyl ethyl ketone | 630 parts by mass |
| Toluene | 210 parts by mass |
| Dimethylformamide | 30 parts by mass |
| Composition of Second Layer (Image Receiving Layer) | |
| Polyvinyl butyral resin (DENKA BUTYRAL #2000-L, produced by Denki Kagaku Kogyo Co., Ltd.) | 16 parts by mass |
| N,N-Dimethylacrylamide/butyl acrylate copolymer | 4 parts by mass |
| Perfluoroalkyl group-containing oligomer (MEGAFACK F-177, produced by Dainippon Ink and Chemicals, Inc.) | 0.5 part by mass |
| n-Propyl alcohol | 200 parts by mass |

On a surface of a PET film support having a thickness of 130 μm, the coating solution for a first layer was provided, followed by drying at 100° C. to form the first layer (cushioning layer) having a dry thickness of 20 μm. Thereafter, the coating solution for a second layer was applied on the first layer, followed by drying at 100° C. to form the second layer (image receiving layer) having a dry thickness of 2 μm, whereby an image receiving body A was obtained.

Production of Image Receiving Body B

A smooth paper support weighing 100 g was prepared as a support, and a 10% aqueous gum arabic solution was coated on a surface of the paper support to give a dry thickness of 1.5 μm, followed by drying (water soluble polymer layer).

Production of Transfer Material

A polyethylene terephthalate (PET) film having a thickness of 50 μm was prepared as a support, and a covercoat resin containing a methacrylic acid-base resin as a main component (PLUS SIZE LO-210, produced by Goo Chemical Co., Ltd.) was applied on a surface of the PET film, followed by drying, to give a dry thickness of 15 μm, whereby a transfer material containing a PET film having a covercoat layer formed on the surface thereof was obtained.

Image Formation

The adhesive toner thus obtained was fed into a laser printer (LP-8600FX, produced by Seiko Epson Corp.) and a desired electrostatic latent image (an image corresponding to a yellow component of an original image) was developed with the adhesive toner, to thus form an adhesive first image on the second layer (image receiving layer) of the image receiving body A obtained above (the first image forming step).

Then, the surface of the image receiving layer having the adhesive first image (the image corresponding to a yellow component of an original image) formed thereon was superposed with a surface of the yellow transfer layer of the yellow transfer sheet obtained above in such a manner that both surfaces would face and contact each other, and they were adhered by lamination by passing through a heat roll laminator (120° C.). The yellow transfer sheet was then peeled off, followed by transferring of the yellow transfer layer only onto the adhesive first layer, to thus form a yellow image (the second image forming step).

In a similar manner, the first image forming step and the second image forming step were repeated by using the magenta, cyan and black transfer sheets, in order to form magenta, cyan and black images, respectively, on different image receiving bodies A.

Next, the surface of the image receiving layer of the image receiving body A having the yellow image formed thereon was superposed with the surface of the image receiving layer of the image receiving body B obtained above in such a manner that both surfaces would face and contact each other, and they were adhered by lamination by passing through a heat roll laminator (120° C.). The image receiving body A was then peeled off, and then the yellow inorganic pigment image was transferred onto the image receiving layer of the image receiving body B. The image receiving bodies A having the magenta, cyan and black images were successively superposed with and laminated on the image receiving body B having the yellow image transferred thereto, whereby the respective images were transferred to the image receiving layer to give a full color image (the image transferring step).

Thereafter, the surface of the image receiving layer of the image receiving body B having the full color image formed thereon was superposed with the surface of the covercoat layer of the transfer material obtained above in such a manner that both layers were brought into contact with each other, and they were adhered by lamination by passing through a heat roll laminator (120° C.). Subsequently, only the support of the transfer material was peeled off, followed by transferring of the covercoat layer so as to cover the full color image (the covercoat layer forming step).

Then, a part of the image receiving body B having the full color image formed thereon was immersed in water at the support side, and the support was peeled off and removed by dissolving a part of the water soluble polymer. Thereafter, arrangement was carried out in such a manner that the surface (peeling surface) of the water soluble polymer layer, which was in a dissolved state due to exposure of the paper support to water, was brought into contact with a surface of a ceramic plate (the arranging step). Consequently, the water soluble polymer layer, the full color image (inorganic pigment layer) and the covercoat layer were successively formed on the surface of the ceramic plate.

The ceramic plate described above was calcined at 400° C. for 1 hour and at 850° C. for 1 hour to sinter the inorganic pigment onto the surface of the ceramic plate, to finally produce a ceramic plate having a full color image formed thereon (the calcining step).

As described above, in order to form a sintered image comprising an inorganic material on ceramic materials used for building materials, such as an artistic tile, and ceramic products, images having yellow, magenta, cyan and black colors were successively transferred and formed on the same image receiving body B, whereby a high quality image having excellent resolution and gradation without deviation in hue could be formed. Furthermore, because a multi-color image was freely formed by using a single kind of toner and a printer for forming a monochrome image, which is relatively inexpensive, the image formation was able to be readily carried out at a low cost.

Example 2

Initially, an adhesive toner, transfer sheets each exhibiting four respective colors (yellow, magenta, cyan and black) and image receiving bodies A were produced in the same manner as conducted in Example 1, and inorganic pigment images exhibiting respective hues (yellow, magenta, cyan and black) were formed on the receiving bodies A, respectively.

Production of Image Receiving Body C

An image receiving body C was produced in the following manner. A 10% aqueous gum arabic solution was coated on a surface of a smooth paper support weighing 100 g followed by drying, to give a dry thickness of 1.5 μm, so as to form a first layer (water soluble polymer layer). A covercoat resin containing a methacrylic acid-base resin as a main component (PLUS SIZE LO-210, produced by Goo Chemical Co., Ltd.) was applied on the first layer, followed by drying, to give a dry thickness of 15 μm. Then, a second layer was laminated (image receiving layer) to produce an image receiving body C.

Image Formation

The surface of the image receiving layer of the image receiving body A having the yellow image formed thereon was superposed with the surface of the covercoat layer of the image receiving body C obtained above in such a manner that both surfaces would face and contact each other, and they were adhered by lamination by passing through a heat roll laminator (120° C.). Then, the image receiving body A was peeled off, after which the inorganic pigment image having yellow color was transferred onto the covercoat layer of the image receiving body C. The image receiving bodies A each having the magenta, cyan and black images formed thereon were successively superposed with and laminated on the image receiving body C having the yellow image transferred thereon, to allow transferring of the respective images onto the covercoat layer of the image receiving body C, whereby a full color image was obtained (the image transferring step).

Next, a part of the image receiving body C having the full color image formed thereon was immersed in water at the paper support side, to peel off and remove the paper support by dissolving a part of the first layer. Thereafter, arrangement was carried out in such a manner that the surface (peeling surface) of the first layer (water soluble polymer layer), which was in a dissolved state due to exposure of the paper support to water, was brought into contact with a surface of a ceramic plate (the arranging step). Consequently, the water soluble polymer layer, the covercoat layer and the full color image were successively laminated on the surface of the ceramic plate.

The ceramic plate was calcined in the same manner as conducted in Example 1, so as to evaporate and burn away the water soluble polymer layer and the components of the covercoat layer, followed by sintering of the inorganic pigment onto the surface of the ceramic plate, whereby a ceramic plate having full color image was obtained (the calcining step).

As described above, in order to form a sintered image comprising an inorganic material on ceramic materials used for a building material, such as an artistic tile, and ceramic products, images having yellow, magenta, cyan and black colors were successively transferred and formed on the same image receiving body C, whereby a high quality image excellent in resolution and gradation without deviation in hue could be formed. Further, because a multi-color image was freely be formed by using a single kind of toner, and a printer for forming a monochrome image, which is relatively inexpensive, the image formation was readily be carried out at a low cost.

As is apparent from the foregoing, the present invention provides a process for forming an image by utilizing the electrophotographic technique and the transfer method, in which an image comprising an inorganic material excellent in resolution and gradation is formed on the surface of a ceramic material with a simple processing and at a low cost without deviation of hues due to color mixing, even in case of forming a multi-color or full color image.

What is claimed is:

1. A process for forming an image, comprising the steps of:

forming, on a surface of an image receiving layer of an image receiving body A including a support having disposed thereon the image receiving layer, an adhesive first image comprising an adhesive composition;

forming, on the surface of the image receiving layer of the image receiving body A, an inorganic pigment second image that includes a transfer material including an inorganic pigment, by at least contacting the surface of the image receiving layer of the image receiving body A, having the first image formed thereon, with a surface of a transfer layer of a transfer sheet, which transfer layer comprises the transfer material, heating, and transferring the transfer layer corresponding to the adhesive first image onto the surface of the image receiving layer of the image receiving body A;

transferring, onto a surface of an image receiving layer of an image receiving body B including a support having disposed thereon the image receiving layer, the inorganic pigment second image, by at least contacting the surface of the image receiving layer of the image receiving body A with the surface of the image receiving layer of the image receiving body B, and heating the same;

arranging, either before or after peeling off the support of the image receiving body B, the inorganic pigment second image on a surface of a ceramic material; and heating the ceramic material, having the inorganic pigment second image at least arranged thereon, to thereby sinter the inorganic pigment image onto the surface of the ceramic material.

2. A process for forming an image, comprising the steps of:

forming, on a surface of an image receiving layer of an image receiving body A including a support having disposed thereon the image receiving layer, an adhesive first image comprising an adhesive composition;

forming, on the surface of the image receiving layer of the image receiving body A, an inorganic pigment second image that includes a transfer material including an inorganic pigment, by at least contacting the surface of the image receiving layer of the image receiving body A, having the first image formed thereon, with a surface of a transfer layer of a transfer sheet, which transfer layer comprises the transfer material, heating, and transferring the transfer layer corresponding to the adhesive first image onto the surface of the image receiving layer of the image receiving body A;

transferring, onto a covercoat layer of an image receiving body C including a support having disposed thereon the covercoat layer, the inorganic pigment second image, by at least contacting the surface of the image receiving layer of the image receiving body A with the surface of the covercoat layer of the image receiving body C, and heating the same;

arranging, either before or after peeling off the support of the image receiving body C, the inorganic pigment second image and the covercoat layer on a surface of a ceramic material; and heating the ceramic material, having the inorganic pigment second image and the covercoat layer at least arranged thereon, to thereby sinter the inorganic pigment image onto the surface of the ceramic material.

3. A process for forming an image, comprising the steps of:

forming, on a surface of an image receiving layer of an image receiving body A including a support having disposed thereon at least the image receiving layer, an adhesive latent image comprising an adhesive composition, through an electrophotographic technique;

forming, on the surface of the image receiving layer of the image receiving body A, an inorganic pigment image that includes a transfer material, by at least contacting the surface of the image receiving layer of the image receiving body A, having the adhesive latent image formed thereon, with a surface of a transfer layer of a transfer sheet, which transfer layer comprises the transfer material including an inorganic pigment, heating, and transferring the transfer layer corresponding to the latent image onto the surface of the image receiving layer of the image receiving body A;

disposing a covercoat layer on the surface of the image receiving layer of the image receiving body A to which the inorganic pigment image including the transfer material has been formed;

arranging at least the inorganic pigment image and the covercoat layer on the surface of a ceramic material by peeling off the support from the image receiving body A; and heating the ceramic material, having the inorganic pigment at least arranged thereon, to thereby sinter the inorganic pigment image onto the surface of the ceramic material.

4. A process for forming an image, comprising the steps of:

forming, on a surface of a water soluble image receiving layer of an image receiving body A including a water permeable support having disposed thereon the image receiving layer including a water soluble polymer, an adhesive latent image comprising an adhesive composition, through an electrophotographic technique;

forming, on the surface of the image receiving layer of the image receiving body A, an inorganic pigment image that includes a transfer material, by at least contacting the surface of the image receiving layer of the image receiving body A, having the adhesive latent image formed thereon, with a surface of a transfer layer of a transfer sheet, which transfer layer comprises the transfer material including an inorganic pigment, heating, and transferring the transfer layer corresponding to the latent image onto the surface of the image receiving layer of the image receiving body A;

disposing a covercoat layer on the surface of the image receiving layer of the image receiving body A to which the inorganic pigment image including the transfer material has been formed;

arranging the covercoat layer to which the inorganic pigment layer has been formed on the surface of a ceramic material by peeling off the support from the image receiving body A through dissolving the water soluble image receiving layer using water supplied from the side of the support to which the covercoat layer has been formed; and heating the ceramic material, having the inorganic pigment at least arranged thereon, to thereby sinter the inorganic pigment image onto the surface of the ceramic material.

5. The process according to claim 3, wherein forming the covercoat layer comprises at least contacting the surface of the image receiving layer of the image receiving body A with a surface of the covercoat layer of a transfer material having the covercoat layer and heating, to allow the covercoat layer to be transferred onto the image receiving layer of the image receiving body A.

6. The process according to claim 3, wherein the adhesive composition used in the step of forming the adhesive latent image contains at least one binder resin selected from the group consisting of a polyester resin, a butyral resin, an ethylene-vinyl acetate resin and an acrylic resin.

7. The process according to claim 3, wherein the heating in the step of forming the inorganic pigment image is carried out at a temperature from 60 to 150° C.

8. The process according to claim 3, wherein the transfer material used in the step of forming the second image further contains at least one flux selected from the group consisting of lithium carbonate, sodium carbonate, potassium carbonate, lead oxide, bismuth oxide, barium carbonate, strontium carbonate, calcium carbonate, magnesium carbonate, zinc oxide, aluminum oxide, aluminum hydroxide, silicon oxide, boric acid, zirconium oxide and titanium oxide.

9. The process according to claim 3, wherein the ceramic material is at least one of a building material, a ceramic plate, a ceramic ware, a pottery plate, a pottery ware, an enameled ware and a ceramic product.

10. The process according to claim 4, wherein forming the covercoat layer comprises at least contacting the surface of the image receiving layer of the image receiving body A with a surface of the covercoat layer of a transfer material having the covercoat layer and heating, to allow the covercoat layer to be transferred onto the image receiving layer of the image receiving body A.

11. The process according to claim 4, wherein the adhesive composition used in the step of forming the adhesive latent image contains at least one binder resin selected from the group consisting of a polyester resin, a butyral resin, an ethylene-vinyl acetate resin and an acrylic resin.

12. The process according to claim 4, wherein the heating in the step of forming the inorganic pigment image is carried out at a temperature from 60 to 150° C.

13. The process according to claim 4, wherein the transfer material used in the step of forming the second image further contains at least one flux selected from the group consisting of lithium carbonate, sodium carbonate, potassium carbonate, lead oxide, bismuth oxide, barium carbonate, strontium carbonate, calcium carbonate, magnesium carbonate, zinc oxide, aluminum oxide, aluminum hydroxide, silicon oxide, boric acid, zirconium oxide and titanium oxide.

14. The process according to claim 4, wherein the ceramic material is at least one of a building material, a ceramic plate, a ceramic ware, a pottery plate, a pottery ware, an enameled ware and a ceramic product.

* * * * *